US005246551A

United States Patent [19]

Pletcher et al.

[11] Patent Number: 5,246,551

[45] Date of Patent: Sep. 21, 1993

[54] ELECTROCHEMICAL METHODS FOR PRODUCTION OF ALKALI METAL HYDROXIDES WITHOUT THE CO-PRODUCTION OF CHLORINE

[75] Inventors: Derek Pletcher, Romsey, England; J. David Genders, Lancaster, N.Y.; Norman L. Weinberg, East Amherst, N.Y.; Ella F. Spiegel, West Falls, N.Y.

[73] Assignee: Chemetics International Company Ltd., Vancouver, Canada

[21] Appl. No.: 835,147

[22] Filed: Feb. 11, 1992

[51] Int. Cl.[5] ..... C25B 1/16

[52] U.S. Cl. ..... 204/96; 204/98

[58] Field of Search ..... 204/96, 98

[56] References Cited

U.S. PATENT DOCUMENTS

| | | | |
|---|---|---|---|
| 3,963,592 | 6/1976 | Lindstrom | 204/98 |
| 4,246,078 | 1/1981 | Broniewski | 204/98 |
| 4,299,673 | 11/1981 | Broniewski | 204/98 |
| 4,337,126 | 1/1982 | Gilligan et al, | 204/98 |
| 4,477,322 | 10/1984 | Foller | 204/103 |
| 4,561,945 | 12/1985 | Coker et al. | 204/98 |
| 4,595,469 | 6/1986 | Foller | 204/98 |

FOREIGN PATENT DOCUMENTS

| | | |
|---|---|---|
| 0031660 | 8/1981 | European Pat. Off. . |
| 118940 | 4/1977 | Japan . |

*Primary Examiner*—John Niebling
*Assistant Examiner*—Patrick J. Igoe
*Attorney, Agent, or Firm*—Howard M. Ellis

[57] ABSTRACT

Methods for the electrolysis of aqueous solutions of alkali metal carbonates and bicarbonates for the production of alkali metal hydroxides at current efficiencies of >85 percent without the simultaneous co-production of halogen or acid can be performed at very low, commercially attractive cell voltages and at high current densities in single or two solution compartment cells with carbon dioxide as the only substantive co-product by maintaining cell pH at >7. The methods are also especially suitable for retrofitting existing chlor-alkali facilities for shifting the balance of production in favor of caustic soda at peak demands. The methods may also be performed with fuel cell configurations for even more attractive operating economics.

39 Claims, 2 Drawing Sheets

ELECTROCHEMICAL METHODS FOR PRODUCTION OF ALKALI METAL HYDROXIDES WITHOUT THE CO-PRODUCTION OF CHLORINE

This invention was made with Government support under Grant No. ISI-9060067 awarded by the National Science Foundation. The Government has certain rights in this invention.

BACKGROUND OF THE INVENTION

The present invention relates generally to methods for the production of alkali metal hydroxides, and more specifically, to methods for the electrochemical synthesis of caustic soda without the customary co-production of chlorine.

Alkali metal hydroxides are manufactured in the United States to the extent of approximately 36,500 tons/day, almost entirely by the electrolysis of aqueous brine solutions. In addition to sodium hydroxide the electrochemical synthesis results in the co-production of chlorine. The electrolysis of brine can be shown by Equation I as follows:

$$2NaCl + 2H_2O \rightarrow 2NaOH + Cl_2 + H_2 \quad (I)$$

Unlike alkali metal hydroxides, chlorine produced at the anode of an electrolytic cell in stoichiometric quantities to sodium hydroxide has experienced a declining market because of environmental problems. For example, use of chlorine by the pulp and paper industry has been declining because of traces of dioxin formed in paper products; chlorine in the treatment of sewage and water has been shown to lead to the production of toxic organo-chlorine compounds; compounds like the chlorofluorocarbons and methyl chloroform have been found to be destructive to the earth's protective ozone layer, and certain chlorine-containing pesticides have been shown to be toxic to biological systems. Consequently, it is expected that the declining demand for chlorine will continue to weaken in the approaching decades. By contrast, the demand for alkali metal hydroxides, like caustic soda is expected to remain strong.

Accordingly, in view of the declining demand for chlorine and the absence of economical routes for its destruction or safe storage there is a growing need for new and more economical processes for the manufacture of high purity alkali metal hydroxides which do not also produce halogens A number of methods have been developed for the production of alkali metal hydroxides without the simultaneous production of chlorine. While most methods are effective in eliminating the problems associated with the co-production of chlorine most have not been viewed as commercially acceptable because of various shortcomings, e.g. inefficient consumption of power, inability to produce a sufficiently pure grade of caustic soda and/or co-production of other less desirable products For example, one of the earliest methods for the production of caustic soda without the co-production of chlorine was the so called "lime-soda" process based on the following reaction $$Ca(OH)_2 + Na_2CO_3 \rightarrow CaCO_3 + 2NaOH \quad (II)$$

The lime-soda process has several shortcomings. It is difficult to carry out to full conversion; the caustic soda is impure and the process is energy inefficient, particularly if there is any attempt to recycle the calcium by thermal decomposition of the carbonate to oxide.

U.S. Pat. Nos. 3,963,592 and 4,561,945 disclose processes for the production of sodium hydroxide and hydrogen at the cathode by salt splitting methods in which electrochemical cells employed are equipped with hydrogen depolarized anodes for oxidation of hydrogen to form protons. U.S. Pat. No. 3,963,592 provides for the oxidation of elemental hydrogen at the anode to hydrogen ions which in turn can react with the chloride ions in the brine electrolyte to form hydrochloric acid. If desired, elemental chlorine may be formed by the oxidation of chloride ions at the anode in which case hydrogen is not fed to the anode.

Like U.S. Pat. No. 3,963,592, U.S. Pat. No. 4,561,945 also relates to the production of alkali metal hydroxide and hydrogen at the cathode and acid at a hydrogen consuming anode. The principal object of the '945 patent is to provide a recycling process for large quantities of sodium sulfate by-product generated in the production of rayon by converting it to caustic soda and sulfuric acid used in manufacturing rayon. Thus, while U.S. Pat. No. 4,561,945 mentions several salts which may be electrolyzed in the synthesis of alkali metal hydroxides all are associated with the simultaneous co-production of acid, and in particular sulfuric acid, as shown by the following equation III:

$$Na_2SO_4 + 3H_2O \rightarrow 2NaOH + H_2SO_4 + \tfrac{1}{2}O_2 + H_2 \quad (III)$$

The electrochemical synthesis of alkali metal hydroxides with the co-production of acid has significant shortcomings not recognized by the above U.S. patents, and in particular U.S. Pat. No. 4,561,945. With electrochemical cells having hydrogen depolarized anodes oxidizing elemental hydrogen to $H^+$in the co-production of acid there is also a competition of $H^{30}$ with the sodium or other alkali metal ion in membrane selectivity. In membrane separated two compartment electrochemical cells having an anolyte side and a catholyte side, as the acid concentration in the anolyte side increases the hydrogen ion prevails over the metal ion. In the case of the electrolysis of sodium sulfate (U.S. Pat. No. 4,561,945) the anolyte will typically have a $pH < 1$. This causes a reduction in alkali metal hydroxide current efficiency and higher power consumption/ton of product produced.

U.S. Pat. No. 4,561,945 discloses the use of a two membrane/three compartment type electrochemical as an alternative to the two compartment cell. The center compartment of the three compartment cell receives the sodium sulfate electrolyte protecting the carbon based gas diffusion anode from the deleterious effects of sulfate ion and sulfuric acid produced in the process. However, a two membrane/three compartment type cell has significant shortcomings, namely higher capital costs, elevated cell voltages and greater power consumption due to increased iR loss. A voltage penalty of $>0.5$ V can occur in a three compartment electrochemical cell which translates into a 25 to 50 percent increase in power consumption over similar two compartment cells. Hence, while it would be more desirable to employ a two compartment cell in methods of making alkali metal hydroxides without the co-production of chlorine, methods proposed heretofore providing for the co-production of acid have meant significant trade-offs in terms of higher capital and operating costs, including life expectancy of cell components.

Accordingly, there is a need for a more economical and energy efficient method for the electrochemical synthesis of alkali metal hydroxides without the co-production of chlorine and acid.

SUMMARY OF THE INVENTION

It is therefore a principal object of the invention to provide for more economic and energy efficient methods for the electro-chemical synthesis of high purity solutions of alkali metal hydroxides without the simultaneous co-production of halogens or acids. Because non-halogen containing salts are employed as electrolytes the process is friendly to the environment.

It is a further object of the invention to provide improved methods for the electrochemical synthesis of alkali metal hydroxides which are not dependent on electrolytic cells having three or more solution compartments. It was discovered that electrolysis of a select group of salts, i.e. alkali metal carbonates, alkali metal bicarbonates and the like, can be performed in single membrane-two solution compartment cells with hydrogen consuming anodes at an anolyte pH of about 9 to about 12 without the simultaneous production of acids. By maintaining the pH of the electrolyte in the alkaline range, i.e. pH>7, only carbon dioxide and water are produced as secondary products. Accordingly, because only carbon dioxide and water are produced at the anode under less aggressive conditions the higher capital and operating costs associated with the co-production of sulfuric and other acids in two membrane/three solution compartment electrolytic cells required by earlier methods can be eliminated. The methods disclosed herein have the added benefit of being suitable for use in single membrane/two solution compartment cells permitting lower operating cell voltages, i.e. at least 0.5 V for reduced energy consumption at savings ranging from about 25 to about 50 percent or even more.

It is yet a further object of the invention to provide methods for the electrochemical synthesis of alkali metal hydroxides without the co-production of low concentration acids, e.g. dilute sulfuric acid, thereby eliminating disposal/storage problems of large quantities of far less valuable acid.

Methods generally contemplated by the invention for the production of alkali metal hydroxides without the simultaneous co-production of chlorine include the steps of:

a) providing an electrochemical cell, comprising a hydrogen consuming anode and an alkali metal hydroxide producing cathode;

b) introducing an electrolyte solution into the electrochemical cell, the solution comprising a salt selected from the group consisting of an alkali metal carbonate, alkali metal bicarbonate, and mixtures thereof;

c) impressing a voltage across the anode and cathode to produce alkali metal hydroxide and in addition in one embodiment, the production of hydrogen at the cathode, and d) feeding a source of hydrogen to the hydrogen consuming anode while maintaining the electrolyte solution in the electro-chemical cell at a pH>7 to produce carbon dioxide and water.

It is still a further object of the invention to provide for methods of making caustic soda, including carbon dioxide and water, without chlorine or acid in an electrochemical cell, with or without a cell divider positioned between the anode and cathode. The divider may consist of a porous diaphragm or a cation exchange permselective membrane. While the invention contemplates as a preferred embodiment the use of a cell divider to form separate compartments for the anolyte and catholyte the methods may be practiced without a membrane or diaphragm, advantageously for even lower cell voltages. This is intended mainly when purity requirements of the alkali metal hydroxides are less critical.

In this regard, a further object is to provide a method for the electrolysis of alkali metal salts, and particularly alkali metal carbonates and bicarbonates for the production of hydrogen and high purity alkali metal hydroxide solutions at the cathode at concentrations ranging from 5 to 50 percent by weight, and carbon dioxide and water at hydrogen consuming anodes. The method includes the step of providing a hydrogen consuming anode comprising a dry side and a wet anolyte side wherein at least a substantial portion of the carbon dioxide generated at the anode is discharged from the relatively dry side. Especially in the absence of a cell divider this assures little of the alkali metal hydroxide formed at the cathode being lost by reacting with the carbon dioxide.

By discharging most of the carbon dioxide from the dry side of the hydrogen consuming anode a further benefit, namely lower cell voltages can be achieved. By discharging carbon dioxide and hydrogen in this manner there is less accumulation of gas bubbles on the wet side thereby reducing the potential for gas blinding at the anode and greater iR loss which otherwise can occur from an insulative blanket of bubbles developing. Accordingly, the methods as disclosed herein include the step of discharging carbon dioxide at the anode at sufficient rates to maintain cell voltages at $<1.8$ V and at current densities of at least 200 mA/cm$^2$.

It is still a further principal object to provide a method for producing an alkali metal hydroxide without the simultaneous production of chlorine by the steps of:

a) providing an electrochemical cell comprising a hydrogen consuming anode in an anolyte compartment, a high performance cathode in a catholyte compartment and a cell divider positioned therebetween;

b) introducing an electrolyte solution into the anolyte compartment, the solution comprising a salt selected from the group consisting of an alkali metal carbonate, alkali metal bicarbonate, and mixtures thereof;

c) introducing an aqueous solution into the catholyte compartment, the aqueous solution comprising alkali metal cations from the anolyte compartment;

d) impressing a voltage across the anode and cathode to produce alkali metal hydroxide and hydrogen at the cathode;

e) feeding a source of hydrogen to the hydrogen consuming anode while maintaining the electrolyte solution in the anolyte compartment at a pH>7 to produce carbon dioxide and water, and f) maintaining a sufficient concentration of the alkali metal salt in solution in the anolyte compartment and at a sufficiently high temperature to provide a cell voltage of $<2.0$ V at a current density of at least 100 mA/cm$^2$ and a alkali metal hydroxide current efficiency of at least 85 percent.

Preferably, the above mentioned electrochemical cell is a two solution compartment type. For purposes of this invention the expression "high performance cathode" is intended to mean an electrode capable of lowering cell voltages by at least 100 mV below that of a conventional steel cathode as commonly employed in the chlor-alkali industry.

It is still a further object of the invention to provide a method for producing alkali metal hydroxides without the simultaneous co-production of chlorine which is compatible for coupling to a hydrogen generating facility, such as an existing chlor-alkali process. The methods of the present invention are especially suitable in retrofitting an existing electrochemical process for the production of chlorine/caustic soda to enable shifting the balance of production in favor of caustic soda to meet peak demands. Accordingly, it is an object of the invention to provide a method for producing caustic soda without the simultaneous production of chlorine which includes the step of feeding hydrogen to the hydrogen consuming anode from a source other then the aforementioned electrochemical cell having a hydrogen consuming anode.

When retrofitted to an existing production facility in which sufficient molecular hydrogen is available alkali metal hydroxide may also be produced according to the invention without the co-production of halogen, acid or further hydrogen. In addition to a hydrogen consuming anode the invention contemplates a very low energy consuming electrochemical cell having an air or oxygen consuming cathode which eliminates the co-production of additional hydrogen at the cathode. In fact, the invention contemplates such a cell operating as a net energy producing electrochemical cell, i.e. fuel cell. Thus, it is yet a further object of the invention to provide a method for the production of alkali metal hydroxides without the simultaneous production of chlorine, acid, as well as hydrogen by the steps of:

a) providing an electrochemical cell comprising a hydrogen consuming anode and a gas consuming cathode;

b) introducing an electrolyte solution into the electrochemical cell, the solution comprising a salt selected from the group consisting of an alkali metal carbonate, alkali metal bicarbonate, and mixtures thereof;

c) feeding a source of gas to the gas consuming cathode selected from the group consisting of air, oxygen and mixtures thereof;

d) impressing a voltage across the anode and cathode to produce alkali metal hydroxide at the cathode, and e) feeding a source of hydrogen to the hydrogen consuming anode while maintaining the electrolyte solution in the electro-chemical cell at a pH $>7$ to produce carbon dioxide and water at the anode.

The foregoing energy producing electrochemical cell can be operated with or without a cell divider, such as a porous diaphragm or cationic permselective membrane. The source of hydrogen feed to the cell can be any available supply, including hydrogen generated by other electrochemical cells dedicated to the production of alkali metal hydroxides, hydrogen and halogens.

These and other objects, features and advantages of the invention will become more apparent from the detailed written description below. However, for a further understanding of the invention, reference should first be made to the accompanying drawings wherein.

DETAILED DESCRIPTION OF THE INVENTION

In discussing the various embodiments of the invention reference may be made to a specific end product, such as caustic soda or sodium hydroxide. However, it is to be understood that reference to such a specific product is for purposes of convenience only, and it should not be construed as limiting as to the scope of products intended to be made according to the methods described herein. Accordingly, the processes described in detail below are intended to relate to the alkali metal hydroxides, namely sodium, potassium and lithium hydroxides.

In one main embodiment of the invention the production of alkali metal hydroxides and hydrogen at the cathode and carbon dioxide and water at the anode can be shown by chemical reactions IV and V:

$$2HOH + 2e \rightarrow 2OH + H_2 \uparrow \text{ (Cathode)} \quad \text{(IV)}$$

$$CO_3^{-2} + H_2 \rightarrow CO_2 \rightarrow + HOH + 2e \text{ (Anode)} \quad \text{(V)}$$

The overall chemical reaction in the cell is shown as reaction VI:

$$Na_2CO_3 + H_2O \rightarrow 2NaOH + CO_2 \uparrow \quad \text{(IV)}$$

The invention relates mainly to highly efficient and economic methods for the production of bases in which most of the power is utilized in the electrochemical synthesis of useful alkali metal hydroxides with only minor amounts of power being expended in the electrolysis of water. The alkali metal hydroxide solutions formed have concentrations ranging from about 5 to about 50 percent by weight, and more preferably $>20$ percent by weight. The purity of the caustic solutions may vary depending on end use requirements. For instance, methods disclosed herein performed with an electro-chemical cell equipped with semi-permeable cation exchange membranes are capable of generating "membrane quality" caustic soda which is substantially free of alkali metal carbonate, etc., electrolyte.

Figure 2:
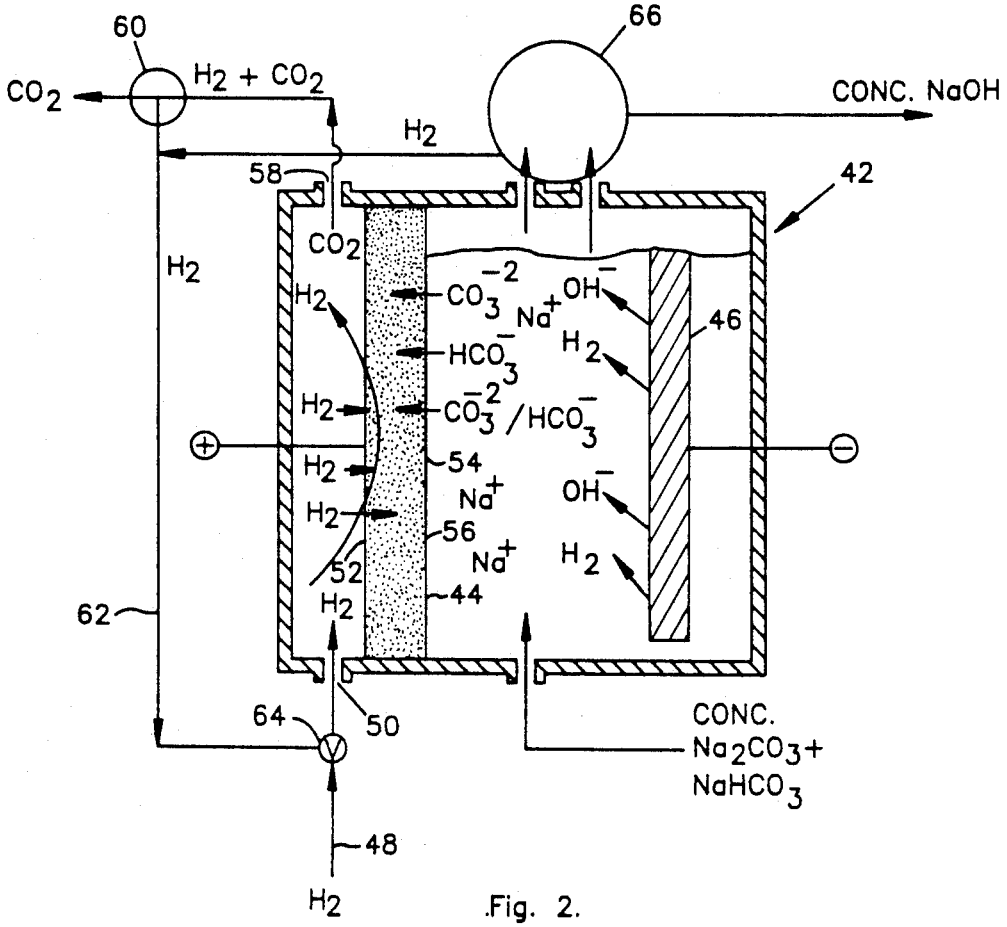
FIG. 2 is a diagrammatic side sectional view of an undivided electrochemical cell for production of alkali metal hydroxide without the co-production of halogen, e.g. chlorine or acid.
Figure 3:
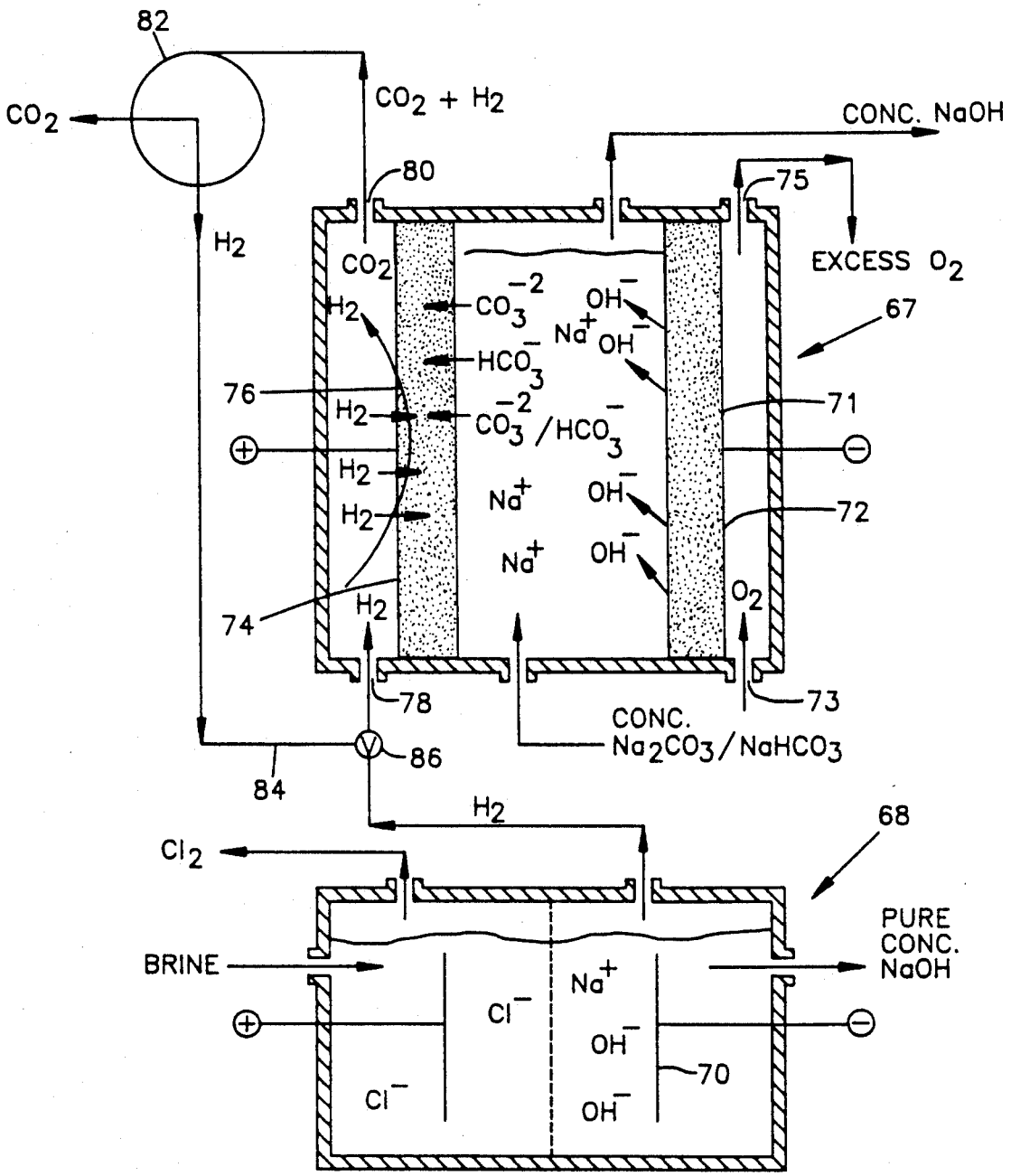
FIG. 3 is a diagrammatic side sectional view of an electro-chemical cell for production of alkali metal hydroxide without the simultaneous production of chlorine, acid or hydrogen in combination with a chlor-alkali electrochemical cell.

Applications not requiring such high purity alkali metal hydroxides can also be prepared according to alternative embodiments wherein the methods are conducted in a cell equipped with a porous diaphragm or in an undivided electrochemical cell (FIGS. 2-3).

The methods are also noteworthy in their ability to operate at high caustic current efficiencies of at least 85 percent, and more preferably at current efficiencies in the range of about 90 to about 95 percent. Optimally, the alkali metal hydroxides may be prepared at current efficiencies $>95$ percent and at cell voltages of less than about 2.6 V, and preferably at very low voltages of less than about 1.8 V, and even more preferably at voltages of 1.5 V or less and at current densities of at least 100 $mA/cm^2$, and more specifically, at current densities in the range of 100 to about 300 mA/cm$^2$. Because of the highly efficient use of power the methods are capable of producing caustic soda at <1300 kWh/ton, e.g. 1000 kWh/ton.

The methods, which are based on the electrochemical conversion of mainly alkali metal carbonates, alkali metal bicarbonates and mixtures of the same to alkali metal hydroxides without the co-production of chlorine or other halogens and acids, have as their only substantive co-product carbon dioxide which can be readily converted to merchantable forms, i.e. liquid or solid $CO_2$, by methods well known in the art. It will be understood that such methods form no part of this invention. Suffice it to say that carbon dioxide has an expanding commercial market in the areas of synthesis, extraction, supercritical fluid chemistry, etc.

Figure 1:
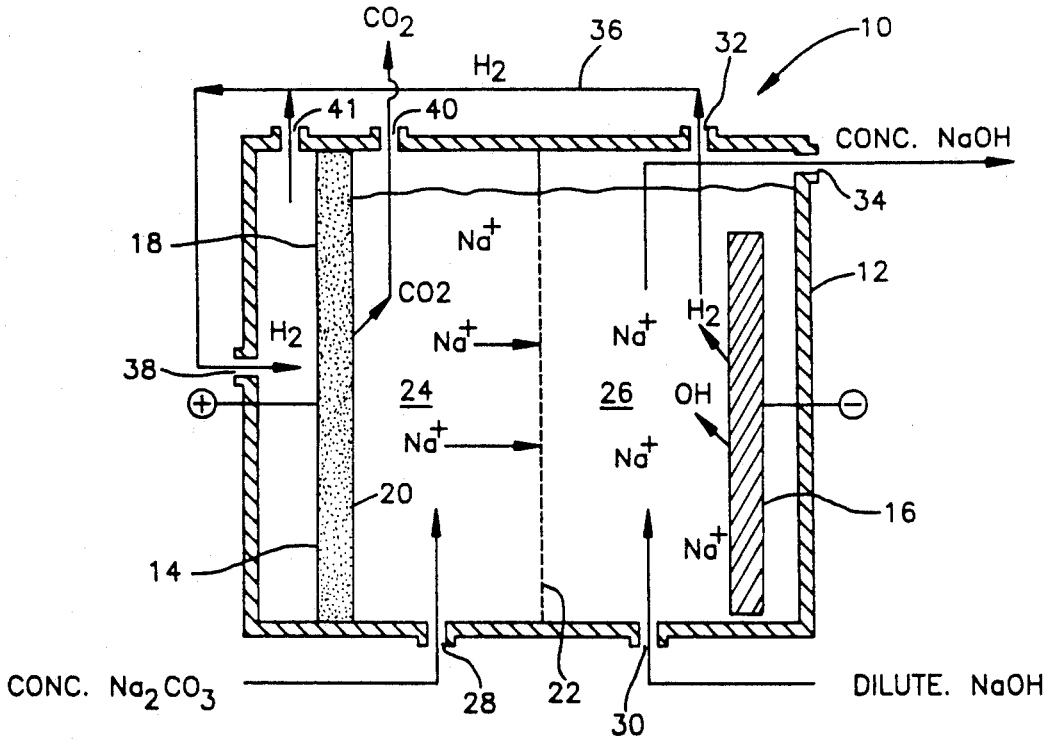
FIG. 1 is a diagrammatic side sectional view of a single divider, two solution compartment electrochemical cell with an alkali metal hydroxide and hydrogen producing cathode and a hydrogen consuming anode.

Turning first to FIG. 1, there is shown an electrochemical cell 10 with a housing 12 for a hydrogen consuming anode 14, a caustic producing multi-dimensional cathode 16 and a cell divider 22 positioned between the anode and cathode. For purposes of this invention expressions like hydrogen consuming anode, hydrogen breathing anode, hydrogen depolarized anode, air or oxygen consuming cathode as employed in other embodiments discussed in detail below, or simply gas diffusion electrode whether anode or cathode are used interchangeably, and are intended to refer to the same type of operating electrode except for the gas consumed. Differences which may exist between individual electrodes of this type are compositional and structural which are discussed in further detail below.

Suitable gas diffusion anodes, and in other embodiments of the invention employing air or oxygen consuming cathodes, are intended generally to mean porous electrode structures either homogeneous composites; heterogeneous layered-laminated composite-like structures, and so on. Because they are porous in nature such electrodes have a dry side 18 (FIG. 1) to which hydrogen or other gas may be fed, and a wet or anolyte solution side 20. Internally, the electrode can be characterized as having a three-phase interface formed of gas, e.g. hydrogen; electrolyte solution and electrode material.

Compositionally, a gas or hydrogen consuming anode 14 may contain a corrosion stable, electrically conductive base support comprised of an amorphous carbon, such as carbon black, fluorinated carbons like the specifically fluorinated carbons described in U.S. Pat. No. 4,908,198 and available under the trademark SFC TM carbons from The Electrosynthesis Company, Inc., East Amherst, N.Y. Other representative examples of electrically conductive base materials include substoichiometric titanium oxides, and particularly the so called Magneli phase substoichiometric titanium oxides having the formula $TiO_x$ wherein x ranges from about 1.67 to about 1.9. A preferred specie of substoichiometric titanium oxide is $Ti_4O_7$. Magneli phase titanium oxides and methods of manufacture are described in U.S. Pat. No. 4,422,917 (Hayfield) which teachings are incorporated-by-reference herein. They are also commercially available under the trademark Ebonex ®.

Preferably, the gas diffusion electrodes of the invention also contain an electrocatalyst for aiding in electrochemical dissociation, e.g. hydrogen at the anode and reduction of oxygen at the cathode, for example. Representative electrocatalysts may consist of highly dispersed metals or alloys of the platinum group metals, such as platinum, palladium, ruthenium, rhodium and iridium; known electrocatalytic metal oxides; organometallic macrocyclic compounds, and other electrocatalysts well known in the fuel cell art for electrochemical dissociation of hydrogen or reduction of oxygen.

While the above description of hydrogen or gas consuming electrodes relates principally to porous homogeneous composite structures, for purposes of the invention such electrodes are also intended to include heterogeneous, layered type composite structures wherein each layer may have a distinct physical and compositional make-up, e.g. porosity and electroconductive base to prevent flooding, for example, and loss of the three phase interface, and resulting electrode performance.

The gas consuming electrodes of the present invention are intended to include anodes and cathodes having porous polymeric layers on or adjacent to the anolyte solution side of the electrode which assist in decreasing penetration and electrode fouling. Stable polymeric resins or films are included in a composite electrode layer adjacent to the anolyte comprising resins formed from non-ionic polymers, such as polystyrene, polyvinyl chloride, polysulfone, etc., or ionic-type charged polymers like those formed from polystyrenesulfonic acid, sulfonated copolymers of styrene and vinylbenzene, carboxylated polymer derivatives, sulfonated or carboxylated polymers having partially or totally fluorinated hydrocarbon chains and aminated polymers like polyvinylpyridine, are but a few examples. Stable microporous polymer films may also be included on the dry side to inhibit electrolyte penetration.

The cell configuration of FIG. 1 is illustrated with a bi-dimensional low overpotential cathode 16 which is a high performance cathode. The expression "high performance cathode" is intended to mean an electrode capable of lowering cell voltages by at least 100 mV below that of a conventional steel cathode. This would include cathodes known in the art preferably coated with high surface area coatings of precious metals, precious metal alloys, nickel, and the like. The cathode chemistry corresponds to reaction IV leading to the evolution of hydrogen and formation of sodium hydroxide, for example.

The sodium ions are supplied by migration through a cell divider 22 from anolyte compartment 24 to the catholyte compartment 26. Useful dividers positioned between the anode and cathode to provide two solution compartment cells may be selected from members of the group consisting of porous diaphragms and cation exchange permselective membranes. Porous diaphragms may be any of the well known dividers employed in electrochemical synthesis processes, such as microporous separators formed from such stable materials as polytetrafluoroethylene (PTFE), polypropylene and asbestos, to name but a few.

Cation exchange permselective membranes are especially desirable in those instances where highest concentration and purity caustic soda is desired which is substantially salt-free. Such stable cation exchange membranes will restrict the passage of carbonate/bicarbonate ions from entering the catholyte compartment 26 and restrict back migration of hydroxide from the catholyte compartment into the anolyte compartment while allowing passage of alkali metal cations.

It has also been discovered that selection of the appropriate type of permselective membrane can also contribute quite significantly in achieving overall higher caustic current efficiencies at lowest cell voltages. Generally, the membranes found to be most useful in achieving such results are those comprising strong acid resins, like sulfonic acid groups and weak acid resins, such as carboxylic acid groups. Such membranes may be either fluorinated or non-fluorinated, although the fluorinated membranes are usually more preferred. Especially useful membranes are the perfluorinated types generally known as perfluorosulfonic acid and perfluorocarboxylic acid types. Perfluorosulfonic acid membranes are commercially available through ordinary channels of commerce from E.I. DuPont under the trademark Nafion®, and include such representative examples as Nafion 324, and the more preferred Nafion 902. Other strong acid type membranes are those available under the trademark Neosepta® CMI available from Tokuyama Soda Company, Ltd., Japan and RAI-1010 available from RAI Research Corporation, Hauppauge, N.Y. Especially useful perfluorinated weak acid membranes having carboxylic acid groups are available from Asahi Glass under the trademark Flemion®, and includes such representative members as Flemion FCC and type FCA membranes.

A further advantage of the present invention lies in the ability to select from a much wider range of power efficient membranes, i.e. for optimizing current efficiency and voltage drop. This flexibility was not available heretofore in electrochemical methods for the production of alkali metal hydroxides without the co-production of chlorine, and particularly in those processes providing for the co-production of acids, such as in U.S. Pat. No. 3,963,592 and 4,561,945. Because the present methods do not produce an oxidizing agent, i.e. chlorine, at the anode or acid in the anolyte, but instead produces only carbon dioxide and water the operating environment of the cell is less aggressive. Advantageously, with methods of the present invention cell environment becomes a less significant factor thereby allowing much greater flexibility in membrane selection, i.e. basing choice on other criteria, such as lowest cell voltage and capital costs. This also includes, for example, the ability to utilize weak acid membranes having carboxylic acid or salt functionality groups on either the anode or cathode side of the cell, not otherwise possible according to the methods of U.S. Pat. No. 4,561,945 because of the highly acidic environment of the anolyte.

As a further preferred embodiment of the invention it has also been discovered that bi-layered membranes provide high operating efficiencies and low cell voltages. In this regard, the present invention contemplates single membrane/two solution compartment cells wherein the membrane comprises, for instance, a perfluoro-carboxylic acid layer adjacent to the anolyte compartment and a perfluorosulfonic acid layer adjacent to the catholyte compartment.

While FIG. 1 shows electrodes 14 and 16 spaced from cell divider 22, it should be understood this is for illustrative purposes only. In practice, placement of gas diffusion anode 14 and caustic soda and hydrogen evolution cathode 16 relative to the membrane will be to optimize cell voltage and minimize internal resistance (iR). Accordingly, the invention contemplates various cell designs, including both monopolar and bipolar configurations which may also incorporate the well established practice in electrosynthesis of zero gap by positioning cathode 16 flush against the face of cell membrane/divider 22 to reduce iR loss and cell voltage. Likewise, gas diffusion anode 14 will be spacially separated from membrane-cell divider 22 to facilitate discharge of carbon dioxide at the anode and to minimize cell voltage, e.g. $<2.6$ V at a current density of at least 100 mA/cm$^2$, and more preferably, to discharge carbon dioxide at a sufficient rate to maintain the cell voltage at $<1.8$ V and at a current density of at least 200 mA/cm$^2$. By facilitating the discharge of gas from the anode, iR loss will be minimized since an insulative blanket of gas bubbles will be less likely to build-up on wet/anolyte side 20.

As previously stated, the electrolyte preferably comprises inorganic salts of carbonates, bicarbonates and mixtures of the same, and particularly the alkali metal salts, like sodium, potassium and lithium carbonates and bicarbonates. The present invention, however, also contemplates the electrolysis of ammonium and quaternary ammonium carbonates and bicarbonates represented by $R_4N$ where R is hydrogen, alkyl or alkyl and aryl.

Operationally, the cell anolyte compartment 24 is filled through cell inlet 28 with concentrated solutions, e.g. 2 M aqueous solutions of sodium carbonate, etc. The catholyte compartment is initially filled at cell inlet 30 with a dilute solution of sodium hydroxide. The anolyte is preferably maintained at a sufficiently high concentration of the salt in solution and at a sufficiently high temperature to prevent crystallization in the anode. In this regard, the concentration of electrolyte in solution and the temperature of the anolyte should be sufficiently high to provide lowest cell voltages, i.e. $<2.0$ V at a current density of at least 100 mA/cm$^2$ without trade-offs in alkali metal hydroxide current efficiency, i.e. at least 85 percent. Accordingly, another aspect of the invention lies in the discovery that the cell voltage benefits substantially by conducting the process at elevated temperatures in the range from about 60° to about 105° C., and more preferably from about 80° to about 95° C.

Hydrogen generated at the cathode is withdrawn from the cell at outlet 32. Caustic soda having a concentration of $>20$ percent by weight is withdrawn at outlet 34 which can be recycled back to the catholyte compartment for further concentrating, if required. The cell configuration of FIG. 1 shows hydrogen diffusion anode 14 receiving hydrogen directly from catholyte compartment 26 through transmission line 36 to hydrogen inlet 38 to dry side 18 of the anode where anode reaction (V) occurs. Carbon dioxide is withdrawn at outlet 40 and processed for use as an industrial gas by known methods. Any excess hydrogen can be withdrawn at outlet 41 for recycle back to the anode.

FIG. 2 illustrates a further embodiment of the invention wherein electrochemical cell 42 is an undivided cell, that is without a porous diaphragm or semipermeable membrane. This embodiment also illustrates at least a portion of the hydrogen feed to hydrogen consuming anode 44 being supplied from a source other than cell 42. While cell 42 has a hydrogen evolving cathode 46 and a hydrogen consuming anode 44 additional make-up hydrogen 48 may be bled into the system from a secondary source from outside the cell to make up for inefficiencies and losses.

Hydrogen consuming anode 44 of FIG. 2 is shown in an enlarged sectional view with inlet 50 delivering hydrogen to the dry back side 52. By maintaining an electrolyte pH above 7, and more specifically in the range of about 9 to about 11 or 12, carbonate and/or bicarbonate from the electrolyte entering the porous anode on the anode wet side 54 is believed to react with the hydrogen in the anode interior region 56. Carbon dioxide and water are formed in the anode. Advantageously, substantially all the carbon dioxide formed in the hydrogen consuming anode is discharged on the dry side 52 of the anode. This minimizes the potential for higher cell voltages and iR loss due to gas blinding on the wet side of the anode. Hydrogen is fed to the hydrogen consuming anode under sufficient pressure and flow rate to enable discharge of most of the carbon dioxide on the dry side of the anode, but the pressure and flow rate are preferably maintained below the gas breakthrough point of the anode wet side. This minimizes the discharge of carbon dioxide on wet side 54.

Carbon dioxide comprising some residual hydrogen is discharged from cell 42 at gas outlet 58 for treatment in a cryogenic or other separator 60 for separation of the carbon dioxide from the hydrogen for recycle of the hydrogen back to the hydrogen consuming anode through line 62. This will avoid buildup of too high a concentration of carbon dioxide re-entering the dry side of the anode. Any make-up hydrogen from an outside source, such as from a gas cylinder can be added to the return feed through line 48 by regulating valve 64. Hydrogen and caustic soda generated at cathode 46 are withdrawn from the cell and treated in a gas disengager and demister 66 to separate hydrogen from concentrated sodium hydroxide. Hydrogen from gas disengager 66 can be recycled for further use in the methods by adding to return line 62.

As a further embodiment of the invention the methods of producing alkali metal hydroxides without the simultaneous production of halogens are especially adaptable to retrofitting existing electrochemical production facilities. For example, the methods of the present invention can be adapted to an existing chlor-alkali plant in need of expansion of caustic soda capacity, but having sufficient chlorine capacity. FIG. 3 illustrates one method of integrating the process with such a facility without increasing chlorine or hydrogen capacity.

FIG. 3 illustrates a modified electrochemical cell 67 of the present invention for the production of alkali metal hydroxides, in particular caustic soda without the co-production of chlorine which cell is operated in-line with electrochemical cell 68 of conventional design for the production of caustic soda and chlorine. Because electrochemical cell 68 usually produces sufficient hydrogen at cathode 70 for operating electrochemical cell 67 the methods of the present invention can be made even more economic by modifying cell 67 to eliminate the co-production of additional hydrogen.

Cell 67, which may or may not have a divider and is shown in FIG. 3 without a permselective membrane or porous diaphragm, is equipped with a gas consuming cathode 72, e.g. air cathode or oxygen consuming cathode, which is capable of reducing air, oxygen or both air and oxygen mixtures to water and caustic soda concurrently with electrolysis of alkali metal carbonates or bicarbonates. Cell 67 which operates like an energy producing fuel cell consumes oxygen, for instance, which may be fed to the dry side 71 of air cathode 72 through inlet 73. Any excess oxygen may be recovered at outlet 75 for recycling back to inlet 73. As previously stated, the air or oxygen consuming cathodes are analogous to hydrogen consuming anodes employing materials and structural characteristics well established in the fuel cell art for electrolysis of the particular gas.

In addition, cell 67 has a hydrogen consuming anode 74 which receives a hydrogen feed supply on the dry side 76 of the anode through inlet 78 generating carbon dioxide in the manner described above in connection with FIG. 2. Like the embodiment of FIG. 2 most of the carbon dioxide and excess hydrogen are discharged from the dry side of the anode through gas outlet 80. Carbon dioxide may be removed from the mixture by cryogenic separator 82 wherein residual hydrogen is recycled back to the anode through line 84. Most of the feed for the hydrogen consuming anode, however, is derived from the cathode reaction of chlor-alkali cell 68 wherein it is metered into inlet 78 by controlling valve 86.

Thus, cell 67 performs as a net energy producing cell, and in particular a hydrogen/oxygen fuel cell. Electrochemical cell 67 is capable of producing part or most of the electrical power for the production section of the plant.

The following specific examples demonstrate the various embodiments of the invention, however, it is to be understood that they are for illustrative purposes only, and do not purport to be wholly definitive as to conditions and scope.

EXAMPLE I

An initial experiment was conducted in a laboratory scale electrochemical cell to produce "membrane quality" caustic soda at the cathode and carbon dioxide and water at the anode according to the following protocol:

The experiment was performed in a Micro Flow cell from ElectroCell AB (Sweden). The cell was used in a divided configuration by installing a Flemion FCC brand weak acid (carboxylate groups) cation exchange membrane. A gas diffusion anode (8.3 $cm^2$) supplied by Johnson Matthey Electronics containing 5.0 $mg/cm^2$ platinum catalyst was installed in the anolyte compartment along with a stainless steel cathode (10 $cm^2$) in the catholyte compartment. PTFE cell frames were used with Viton gaskets to provide a gap of about 2 mm between each electrode and the membrane. The cell was powered by a Hewlett Packard 6010 A DC power supply with the charged passed recorded on an ESC 640 Digital Coulometer from The Electrosynthesis Co, Inc. A Masterflex pump was used for circulating electrolyte through the cell. 500 ml Erlenmeyer flasks were used as reservoirs for the anolyte and catholyte.

A 2.25 M sodium carbonate solution served as the starting anolyte and a 2.78 M sodium hydroxide solution was used as the catholyte. The starting anolyte had a pH of 12.3. The run was conducted at room temperature. A current density of 100 $mA/cm^2$ was used to pass the required charge of 71,650 Coulombs. The electrolysis was conducted in a galvanostatic mode. The anolyte was maintained throughout the run at a pH in the alkaline range. Upon completion the anolyte had a pH of about 10. The system was drained, the final volumes measured and then rinsed to collect any residue in the system. The anolyte was analyzed for sodium carbonate and sodium bicarbonate using the Winkler Method; the catholyte was analyzed for an increase in sodium hydroxide concentration by titration with a standardized solution of HCl and found to be membrane quality 18 percent by weight sodium hydroxide. The caustic current efficiency of the run was 95%. Cell voltage was 2.3 V.

EXAMPLE II

Surprisingly, it was discovered that electrolysis of alkali metal carbonates and/or bicarbonates using a gas diffusion anode provides a useful means for producing alkali metal hydroxides when chlorine and acid are not in demand. Notwithstanding, it was found that the anode can become surrounded by an insulating layer of hydrogen gas on the backside of the electrode and carbon dioxide gas on the wet anolyte side. The effect of this gas binding is an elevation in cell voltage and increased power costs. In some applications it would also be desirable to be able to operate such an electrolytic cell without a divider/membrane for even lower cell voltages. However, the evolution of carbon dioxide from the wet side of the gas diffusion anode would be readsorbed by the electrolyte with no net gain in the formation of alkali metal hydroxide occurring. Accordingly, it would be desirable to demonstrate the production of alkali metal hydroxides at reasonably high current efficiencies without the co-production of halogen or acid in a single compartment undivided cell, i.e. without a membrane, for lower cell voltages and reduced power consumption.

In performing such an experiment an undivided Micro Flow cell (ElectroCell AB) was equipped with a Johnson Matthey Electronics gas diffusion anode having a platinum catalyst loading of 0.5 mg/cm$^2$ and a stainless steel cathode (area 10 cm$^2$). PTFE cell frames were used with Viton gaskets providing an interelectrode gap of 2 mm. The cell was powered by a Hewlett Packard 6010 A DC power supply with the charged passed recorded on an ESC 640 Digital Coulometer from The Electrosynthesis Co, Inc. A Masterflex pump was used for circulating electrolyte through the cell. An Erlenmeyer flask was used as the electrolyte reservoir.

In order to determine the amount of carbon dioxide evolving from the back/dry side of the anode the gas exiting the backside was passed through a drying tube of calcium chloride (Dri-Rite TM) and then into a tube of previously weighed sodium hydroxide (Ascarite TM) so any carbon dioxide formed from the electrolysis of sodium carbonate and passing through the anode would be adsorbed by the Ascarite. Similarly, the electrolyte reservoir was also sealed with an exit line leading to a drying tube followed by another drying tube containing previously weighed Ascarite adsorption material in order to collect any carbon dioxide coming off the electrode which does not pass through the anode and out the dry side.

Sodium carbonate (2.03 M) having an initial pH of 12 was pumped through the cell at 200 ml/minute while hydrogen gas was introduced on the dry side of the anode. The current density was 100 mA/cm$^2$. Cell voltage was 2.6 V. A charge of 14,475 Coulombs was passed. The final pH of the electrolyte solution was about 12. Analysis showed that the current efficiency for $CO_2$ evolved from the dry side of the anode was 65 percent. Theoretically, the sodium hydroxide current should have been 100 percent. However, the results of the experiment showed that 35 percent of the carbon dioxide evolved on the wet side of the anode. Hence, if the carbon dioxide evolved on the wet side of the anode had been allowed to be readsorbed by the electrolyte the caustic current efficiency would have also been reduced by 35 percent to provide a caustic current efficiency of 65 percent. Titration of the electrolyte for sodium hydroxide showed the current efficiency was actually 69 percent.

The caustic current efficiency can be raised further to $>85$ percent and the cell voltage lowered to $<1.75$ V by a combination of increasing the electrolyte pressure on the anode wet side relative to the hydrogen gas pressure on the dry side thereby increasing the amount of carbon dioxide out the dry side of the anode; using an optimal current density to balance the hydrogen concentration in the anode; reducing the gap/distance between the anode and cathode and/or installing a high performance type catalytic hydrogen cathode of the type employed for chlor-alkali use.

EXAMPLE III

To demonstrate a further embodiment of the invention a chlor-alkali electrochemical cell is set-up with a fuel type cell according to the configuration of FIG. 3. The chlor-alkali cell is a laboratory scale cell from ElectroCell AB (Sweden), designated as an ElectroCell MP cell fitted with a DSA ® chlorine evolving anode with a loading of 0.04 m$^2$ ruthenium oxide on titanium, a steel cathode and a DuPont Nafion ® 901 cation exchange membrane positioned between the electrodes. Hot purified brine solution is circulated into the anolyte compartment while caustic soda solution is circulated into the catholyte compartment, each by means of a pump. The chlor-alkali cell is operated at a current density of 250 mA/cm$^2$ generates chlorine from the anolyte and pure aqueous caustic soda and hydrogen from the catholyte.

A second electrochemical cell is set-up consisting of an undivided MP type cell from ElectroCell AB. Hydrogen from the chlor-alkali cell system is fed to the second electrochemical cell system which is connected in series. The undivided MP cell is fitted with a hydrogen consuming anode designed for efficient hydrogen oxidation, and a gas diffusion cathode designed for efficient reduction of oxygen to hydroxide ions.

Hot aqueous sodium carbonate solution is fed to the second cell and as sodium hydroxide is formed, carbon dioxide is produced at the anode with a substantial portion evolving off the dry side of the hydrogen consuming anode. While the caustic soda produced in the undivided second cell is not as pure as the caustic soda formed in the chlor-alkali cell, a cation exchange membrane introduced into the second cell produces caustic in the catholyte of comparable purity to that produced in the chlor-alkali cell.

The second electrochemical cell produces a fraction of the power consumed by the chlor-alkali cell thereby reducing the electrical energy requirements overall. However, the electrical energy produced by the carbonate electrolysis fuel cell may be fed to other electrical loads requirements.

While the invention has been described in conjunction with specific examples thereof, they are illustrative only. Accordingly, many alternatives, modifications and variations will be apparent to persons skilled in the art in light of the foregoing description, and it is therefore intended to embrace all such alternatives and modifications as to fall within the spirit and broad scope of the appended claims.

We claim:

1. A method for producing an alkali metal hydroxide without the simultaneous production of chlorine, which comprises the steps of:

a) providing an electrochemical cell comprising a hydrogen consuming anode and an alkali metal hydroxide producing cathode;

b) introducing an electrolyte solution into said electrochemical cell, said solution comprising a salt selected from the group consisting of an alkali metal carbonate, alkali metal bicarbonate, and mixtures thereof;

c) impressing a voltage across said anode and cathode to produce alkali metal hydroxide and hydrogen at the cathode;

d) feeding a source of hydrogen to said hydrogen consuming anode while maintaining said electrolyte solution in said electro-chemical cell at a pH>7 to produce carbon dioxide and water, and e) facilitating the discharge of carbon dioxide at said anode at a sufficient rate to maintain cell voltages at <2.6 V and at a current density of at least 100 mA/cm$^2$.

2. The method of claim 1 including the step of feeding hydrogen to said hydrogen consuming anode from a source other then said electrochemical cell.

3. The method of claim 1 including the step of feeding at least a portion of the hydrogen from said cathode to said hydrogen consuming anode.

4. The method of claim 1 including the step of feeding at least a portion of the hydrogen to said hydrogen consuming anode from another electrochemical cell.

5. The method of claim 1 including the step of providing an electrochemical cell comprising a cell divider positioned between said anode and cathode to form an anolyte compartment and a catholyte compartment, said divider being selected from the group consisting of a porous diaphragm and a cation exchange perm-selective membrane.

6. The method of claim 5 wherein said electrochemical cell is a two solution compartment type cell.

7. The method of claim 5 wherein the cell divider is a fluorinated cation exchange permselective membrane comprising chemical functionality selected from the group consisting of carboxylic acid groups, sulfonic acid groups and both carboxylic and sulfonic acid groups.

8. The method of claim 5 wherein the cell divider is a cation exchange permselective membrane comprising a material selected from the group consisting of perfluorosulfonic acid and perfluoro-carboxylic acid types.

9. The method of claim 5 wherein the cell divider is a non-fluorinated cation exchange membrane comprising a material having chemical functionality selected from the group consisting of carboxylic acid groups and sulfonic acid groups.

10. The method of claim 5 wherein the cell divider is a porous diaphragm comprising a material selected from the group consisting of PTFE, polypropylene and asbestos.

11. The method of claim 5 wherein the membranes are bi-layered.

12. The method of claim 11 wherein the membranes are bi-layered and comprise a perfluorocarboxylic acid layer adjacent to the anolyte compartment and a perfluorosulfonic acid layer adjacent to the catholyte compartment.

13. The method of claim 5 including the step of maintaining a sufficient concentration of alkali metal salt in said electrolyte solution in the anolyte compartment to provide a alkali metal hydroxide current efficiency of at least 85 percent.

14. The method of claim 5 including the step of spacially separating the anode and cell divider sufficiently to facilitate the discharge of carbon dioxide at the anode and provide a cell voltage of <2.6 V at a current density of at least 100 mA/cm$^2$.

15. The method of claim 1 including the step of discharging carbon dioxide at the anode at a sufficient rate to maintain the cell voltage at <1.8 V and at a current density of at least 200 mA/cm$^2$.

16. The method of claim 14 including the step of providing a hydrogen consuming anode comprising a dry side and a wet anolyte side wherein a substantial portion of the carbon dioxide generated at the anode is discharged on said dry side.

17. The method of claim 1 wherein the electrochemical cell is undivided and the hydrogen consuming anode comprises a dry side and a wet anolyte side wherein a substantial portion of the carbon dioxide generated at the anode is discharged on said dry side.

18. The method of claim 16 including the step of feeding a source of hydrogen to the hydrogen consuming anode under sufficient pressure and flow rate to enable discharge of a substantial portion of the carbon dioxide on the dry side of said anode, but below the gas breakthrough point of said anode so as to minimize discharge of carbon dioxide on the wet side of said anode.

19. The method of claim 17 including the step of feeding a source of hydrogen to the hydrogen consuming anode under sufficient pressure and flow rate to enable discharge of a substantial portion of the carbon dioxide on the dry side of said anode, but below the gas breakthrough point of said anode so as to minimize discharge of carbon dioxide on the wet side of said anode.

20. The method of claim 13 including the step of providing an electrochemical cell in which at least one of the electrodes comprises a substoichiometric titanium oxide.

21. A method for producing an alkali metal hydroxide without the simultaneous production of chlorine, which comprises the steps of:

a) providing an electrochemical cell comprising a hydrogen consuming anode in an anolyte compartment, a high performance cathode in a catholyte compartment and a cell divider positioned therebetween;

b) introducing an electrolyte solution into said anolyte compartment, said solution comprising a salt selected from the group consisting of an alkali metal carbonate, alkali metal bicarbonate, and mixtures thereof;

c) introducing an aqueous solution into said catholyte compartment, said aqueous solution comprising alkali metal cartions from said anolyte compartment;

d) impressing a voltage across said anode and cathode to produce alkali metal hydroxide and hydrogen at the cathode;

e) feeding a source of hydrogen to said hydrogen consuming anode while maintaining the electrolyte solution in said anolyte compartment at a pH >7 to produce carbon dioxide and water, and f) maintaining a sufficient concentration of said alkali metal salt in solution in said anolyte compartment and at a sufficiently high temperature while facilitating the discharge of carbon dioxide at said anode to provide a cell voltage of <2.0 V at a current density of at least 100 mA/cm$^2$ and a alkali metal hydroxide current efficiency in the range of about 90 to about 95 percent.

22. The method of claim 21 wherein said electrochemical cell is a two solution compartment type cell.

23. The method of claim 21 including the step of providing an electrochemical cell with a hydrogen consuming anode which is carbon based and comprises a catalyst.

24. The method of claim 23 wherein the catalyst comprises a platinum group metal.

25. The method of claim 21 wherein the cell divider is a member selected from the group consisting of a porous diaphragm and a cation exchange permselective membrane.

26. The method of claim 21 wherein the high performance cathode is an electrode capable of lowering cell voltages by at least 100 mV below that of a conventional steel cathode.

27. A method for producing an alkali metal hydroxide without the simultaneous production of chlorine, which comprises the steps of:

a) providing an electrochemical cell comprising a hydrogen consuming anode and a gas consuming cathode;

b) introducing an electrolyte solution into said electro-chemical cell, said solution comprising a salt selected from the group consisting of an alkali metal carbonate, alkali metal bicarbonate, and mixtures thereof;

c) feeding a source of gas to said gas consuming cathode selected from the group consisting of air, oxygen and mixtures thereof;

d) impressing a voltage across said anode and cathode to produce alkali metal hydroxide at the cathode, and e) feeding a source of hydrogen to said hydrogen consuming anode while maintaining said electrolyte solution in said electro-chemical cell at a pH $>7$ to produce carbon dioxide and water at said anode.

28. The method of claim 27 including the step of providing an electrochemical cell comprising a hydrogen consuming anode, a gas consuming cathode, and a cell divider positioned therebetween.

29. The method of claim 28 wherein the cell divider is a member selected from the group consisting of a porous diaphragm and a cation exchange permselective membrane.

30. The method of claim 27 including the step of feeding a source of hydrogen to said hydrogen consuming anode from another electro-chemical cell.

31. The method of claim 30 wherein said source of hydrogen is from a chlor-alkali cell.

32. The method of claim 27 including the step of providing an electrochemical cell having a hydrogen consuming anode comprising a dry side and a wet side wherein at least a substantial portion of the carbon dioxide generated at the anode is discharged on said dry side.

33. The method of claim 27 wherein the electrochemical cell produces at least a portion of the power required for alkali metal hydroxide production.

34. The method of claim 27 wherein the electrochemical cell is a fuel cell.

35. In a method of producing alkali metal hydroxide without the simultaneous production of chlorine in an electrochemical cell comprising a hydrogen consuming anode and an alkali metal hydroxide producing cathode in which an electrolyte solution is introduced into said electrochemical cell comprising a salt selected from the group consisting of alkali metal carbonate, alkali metal bicarbonate and mixtures thereof; impressing a voltage across said anode and cathode to produce alkali metal hydroxide and hydrogen at said cathode, and feeding the hydrogen to said hydrogen consuming anode to produce carbon dioxide and water while maintaining said electrolyte solution at a pH $>7$, the improvement comprising operating said electrochemical cell with a hydrogen consuming anode comprising a polymer selected from the group consisting of non-ionic and ionic charged types to provide a cell voltage of $<2.6$ V and at a current density of at least 100 mA/cm$^2$.

36. The method of claim 35 wherein said hydrogen consuming anode is a composite type electrode having a coating of said ionic charged type polymer.

37. The method of claim 36 wherein said hydrogen consuming composite type electrode comprises a coating of said ionic charged type polymer adjacent to said electrolyte solution.

38. The method of claim 35 wherein said ionic-type polymer containing hydrogen consuming anode includes an electrocatalyst for electrochemical dissociation of hydrogen.

39. The method of claim 35 wherein said electrochemical cell is operated with a hydrogen consuming anode comprising the polymer so as to provide a cell voltage of $<1.8$ V and at a current density of at least 100 mA/cm$^2$.

* * * * *